US006580045B1

(12) United States Patent
Kuo

(10) Patent No.: US 6,580,045 B1
(45) Date of Patent: Jun. 17, 2003

(54) SWITCH WITH PIVOTABLE ACTUATOR

(75) Inventor: Yung-Ming Kuo, Taichung Hsien (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 10/158,884

(22) Filed: Jun. 3, 2002

(51) Int. Cl.[7] ..... H01H 21/82
(52) U.S. Cl. ..... 200/559; 200/6 BB
(58) Field of Search ..... 200/343, 335, 200/558, 559, 6 BB

(56) References Cited

U.S. PATENT DOCUMENTS 3,878,344 A * 4/1975 Lockard ..... 200/6 B
4,311,884 A * 1/1982 Henley et al. ..... 200/217
4,389,549 A * 6/1983 Brown ..... 200/5 R
4,423,300 A * 12/1983 Chesemore et al. ..... 200/339
4,644,110 A * 2/1987 Watanabe et al. ..... 200/5 R
4,975,548 A * 12/1990 Brouilette et al. ..... 200/5 R
5,601,183 A * 2/1997 Boyd et al. ..... 200/553

* cited by examiner

*Primary Examiner*—Elvin Enad
*Assistant Examiner*—Lisa N. Klaus
(74) *Attorney, Agent, or Firm*—Baker Botts L.L.P.

(57) ABSTRACT

A switch includes a lower insulator body having a terminal bridging cavity, front and rear terminals spaced apart from each other and having contact end portions that extend into the terminal bridging cavity, a conductive contact member having an anchoring segment mounted on the lower insulator body and a bridging segment disposed above the contact end portions of the front and rear terminals, an upper insulator body mounted on the lower insulator body and having an actuator mounting cavity, and a pivotable actuator mounted in and extending outwardly of the actuator mounting cavity and having a pressing projection above the bridging segment of the contact member. Operation of the actuator enables the pressing projection to press the bridging segment of the contact member downward so that the contact end portions of the front and rear terminals are bridged together to make electrical connection there between.

4 Claims, 7 Drawing Sheets

SWITCH WITH PIVOTABLE ACTUATOR

BACKGROUND OF THE INVENTION

1. Field of the Invention

The invention relates to a switch, more particularly to a switch with a pivotable actuator.

2. Description of the Related Art

Referring to FIGS. 1, 2, 3 and 4, a conventional state-setting switch 1 is shown to comprise a lower insulator body 2, an upper insulator body 3 mounted on the lower insulator body 2, and a set of switch actuators 4 pivoted to the upper insulator body 3.

The lower insulator body 2 is a rectangular body made of an insulator material, such as rubber or plastic, and has a top surface 21. A flange 23 is disposed around the rim of the top surface 21. A plurality of conductive terminal sets 22 extend parallel to the top surface 21 along a longitudinal direction. Each terminal set 22 includes a long terminal 221 and a short terminal 222. The short terminal 222 extends above the long terminal 221 to make electrical connection therebetween, as best shown in FIG. 3. Each of the terminals 221, 222 extends downwardly to form a terminal tail 223.

The upper insulator body 3 is a rectangular body made of an insulator material, such as rubber or plastic, and has an open bottom end 31, a retaining cavity 32 extending inwardly from the open bottom end 31, and a peripheral wall 33 for engaging the flange 23 of the lower insulator body 2. The upper insulator body 3 further has a set of actuator slots 321, each corresponding to a terminal set 321 of the lower insulator body 2 and being communicated with the retaining cavity 32.

Each switch actuator 4 is made of an insulator material, such as rubber or plastic, and has a mounting portion 41 retained pivotally in the retaining cavity 32, a pressing projection 42 projecting downwardly from the mounting portion 41, and an operating portion 43 extending from the mounting portion 41 outwardly of the retaining cavity 32 via a respective one of the actuator slots 321.

During assembly, the mounting portions 41 of the switch actuators 4 are first mounted pivotally in the retaining cavity 32 of the upper insulator body 3 such that the operating portions 43 extend through the actuator slots 321. Then, with the pressing projections 42 abutting against the long terminals 221, the peripheral wall 33 of the upper insulator body 3 is mounted on the flange 23 of the lower insulator body 2.

As shown in FIG. 4, the application of a pressing force on the operating portion 43 of the actuator 4 will cause the pressing projection 42 to move the long terminal 221 away from the short terminal 222, thus breaking the electrical connection between the terminals 221, 222. The switch 1 is at a switch-off state at this time. As shown in FIG. 3, the application of an uplifting force on the operating portion 43 of the actuator 4 will move the pressing projection 42 away from the long terminal 221 such that, by virtue of the resiliency of the long terminal 221, the long terminal 221 once again contacts the short terminal 222, thus making the electrical connection between the terminals 221, 222. The switch 1 is at a switch-on state at this time.

The following are some of the drawbacks of the aforesaid conventional switch 1:

1. The terminal set 22 is normally made of copper, which is highly susceptible to spring fatigue after a period of use. Spring fatigue results in failure of the long terminal 221 to connect properly with the short terminal 222. This situation is aggravated in view of the contact configuration between the long and short terminals 221, 222, which requires a fairly strong torque on the long terminal 221 to make and break electrical connection with the short terminal 222.

2. No positioning mechanism is provided for stable positioning of the terminal sets 321 during the assembly process, which can result in an increase in defective products during mass production, thereby resulting in lower yield and higher costs.

SUMMARY OF THE INVENTION

Therefore, the main object of the present invention is to provide a switch with a pivotable actuator that can overcome the aforesaid drawbacks of the prior art.

Accordingly, a switch of this invention comprises:

a lower insulator body including a bottom wall with front and rear portions spaced apart in a longitudinal direction, and front and rear lower walls respectively extending upward from the front and rear portions of the bottom wall so as to define an upwardly opening terminal bridging cavity;

front and rear terminals spaced apart from each other in the longitudinal direction, each of the front and rear terminals having a middle portion embedded in a junction between the bottom wall and a respective one of the front and rear lower walls, a contact end portion extending from the middle portion into the terminal bridging cavity, and a connecting end portion extending from the middle portion and outwardly of the terminal bridging cavity;

a resilient conductive contact member having an anchoring segment mounted on the rear lower wall, and a bridging segment extending from the anchoring segment in the longitudinal direction and disposed above the contact end portions of the front and rear terminals in the terminal bridging cavity;

an upper insulator body including a top wall with front and rear ends spaced apart in the longitudinal direction, and front and rear upper walls respectively extending downward from the front and rear ends of the top wall so as to define a downwardly opening actuator mounting cavity, the front and rear upper walls respectively engaging the front and rear lower walls, the upper insulator body having an actuator slot formed through the front upper wall and communicated with the actuator mounting cavity; and a pivotable actuator having a mounting portion disposed pivotally in the actuator mounting cavity and pivotable about a pivot axis that extends in a transverse direction transverse to the longitudinal direction, an operating portion extending from the mounting portion outwardly of the actuator mounting cavity via the actuator slot, and a pressing projection projecting downwardly from the mounting portion toward the bridging segment of the contact member.

Application of a pressing force on the operating portion of the actuator causes the actuator to pivot in the actuator mounting cavity to a switch-on state and enables the pressing projection to press the bridging segment of the contact member downward so that the bridging segment bridges together the contact end portions of the front and rear terminals to make electrical connection between the front and rear terminals.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
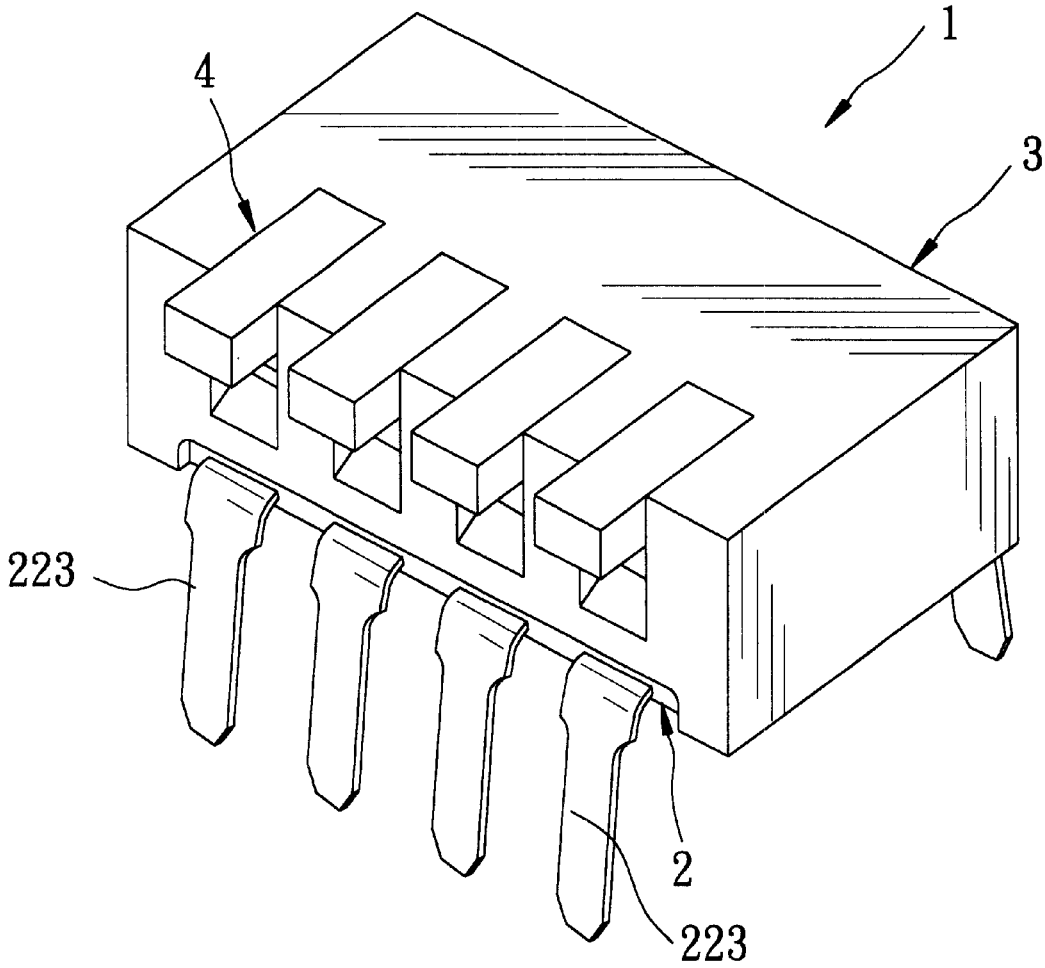
FIG. 1 PRIOR ART
FIG. 1 is a perspective view of a conventional state-setting switch.
Figure 2:
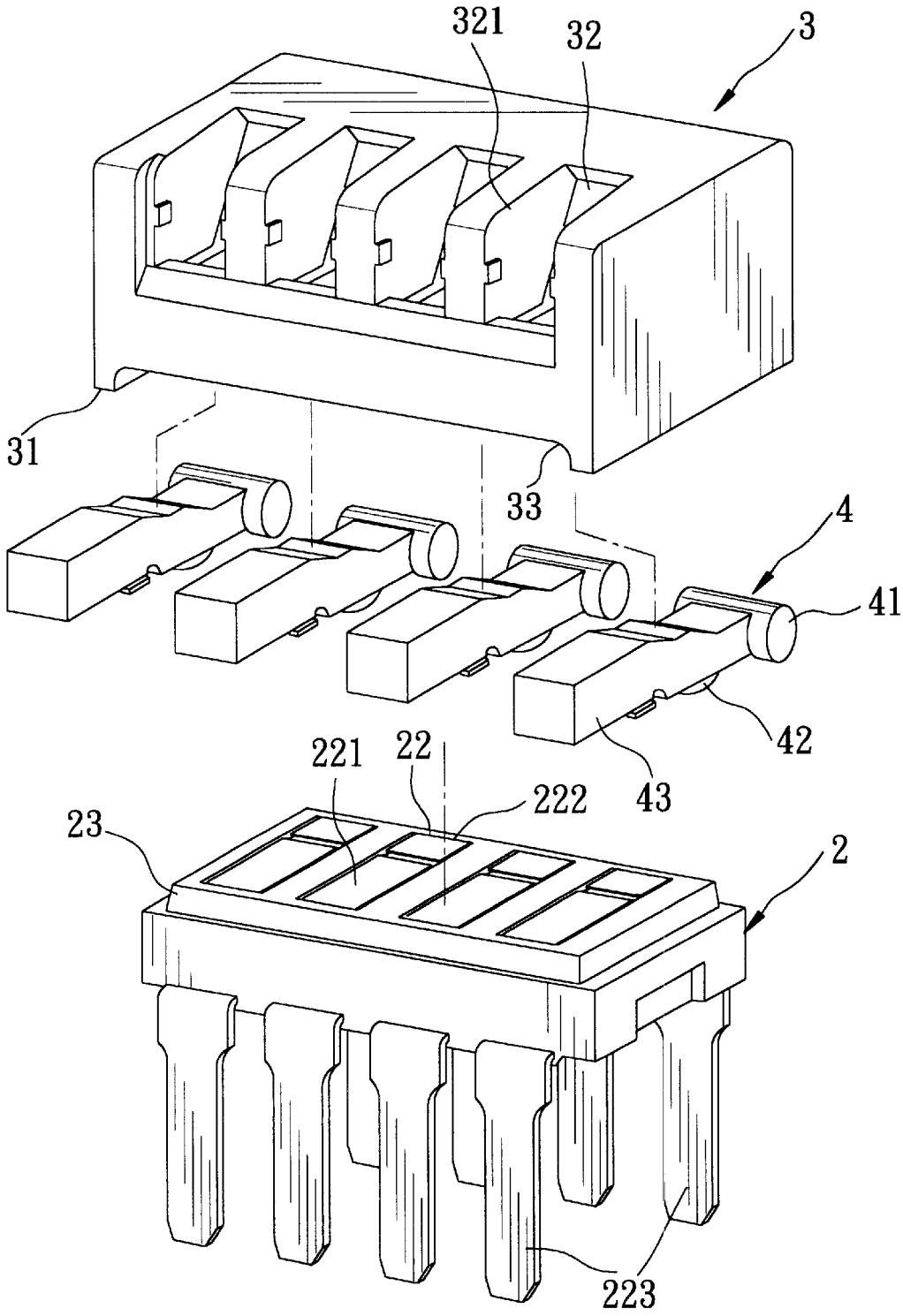
FIG. 2 PRIOR ART
FIG. 2 is an exploded perspective view of the conventional switch of FIG. 1.
Figure 3:
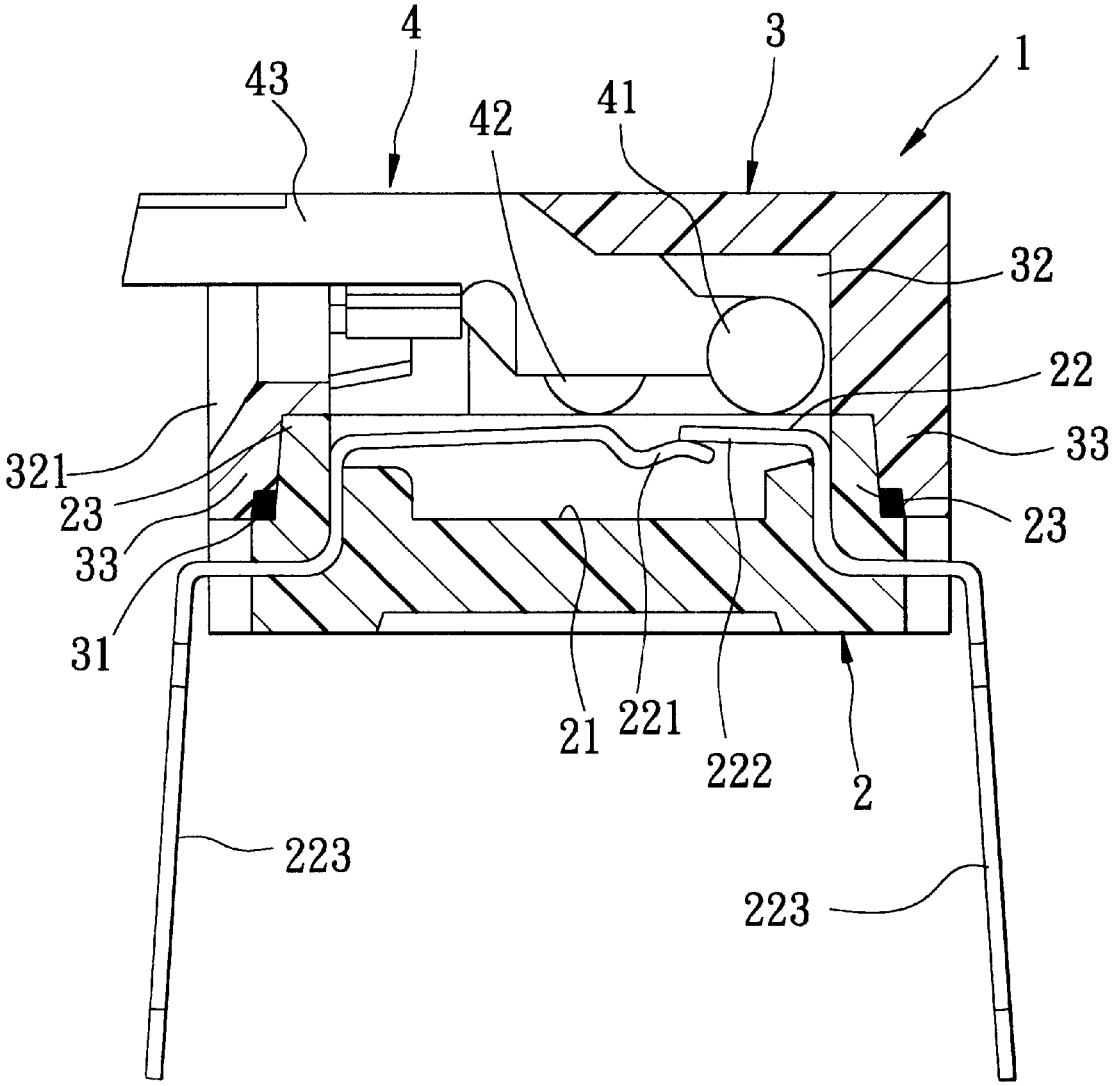
FIG. 3 PRIOR ART
FIG. 3 is an assembled partly sectional view of the conventional switch of FIG. 1 in a switch-on state.
Figure 4:
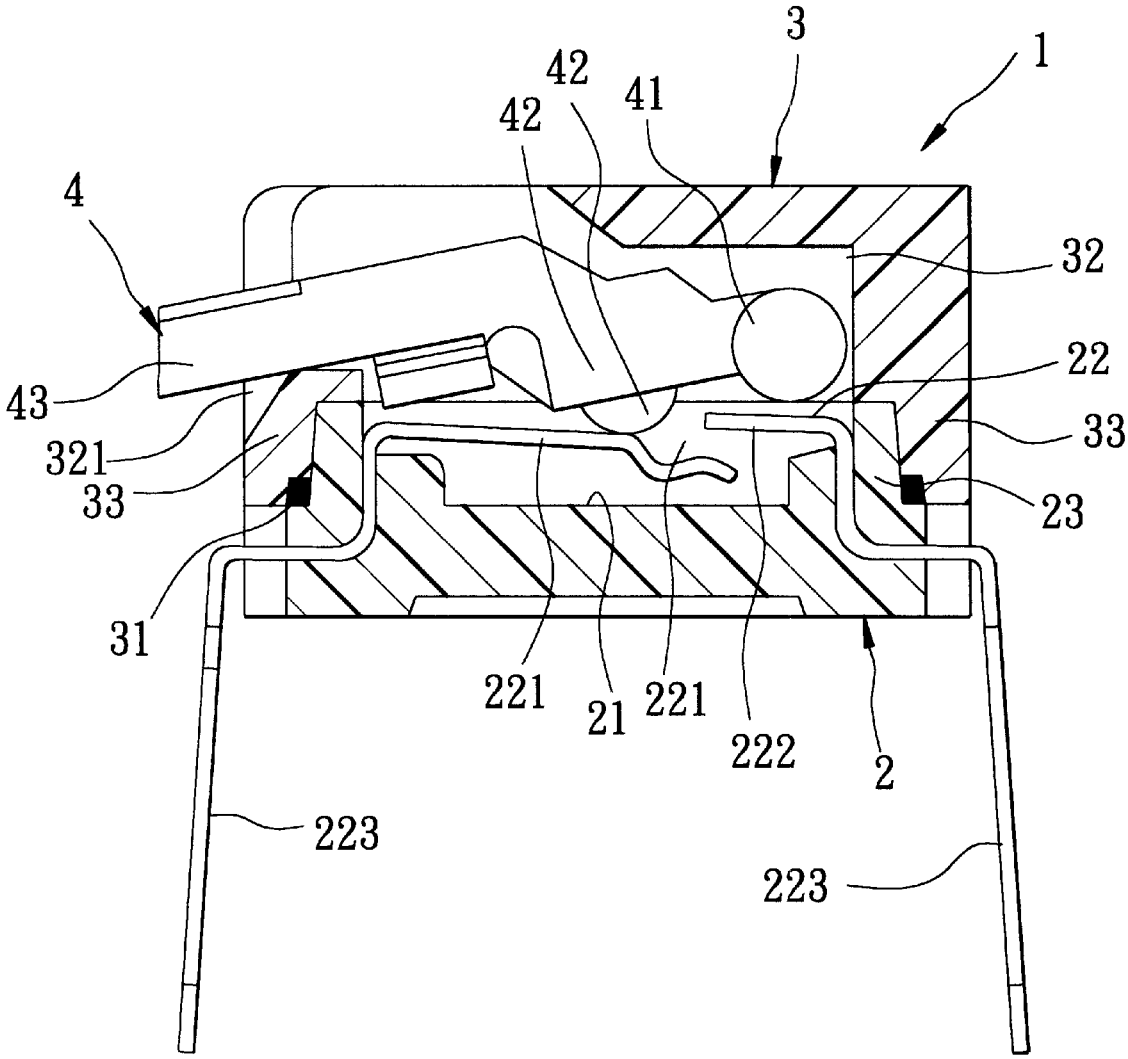
FIG. 4 PRIOR ART
FIG. 4 is an assembled partly sectional view of the conventional switch of FIG. 1 in a switch-off state.
Figure 5:
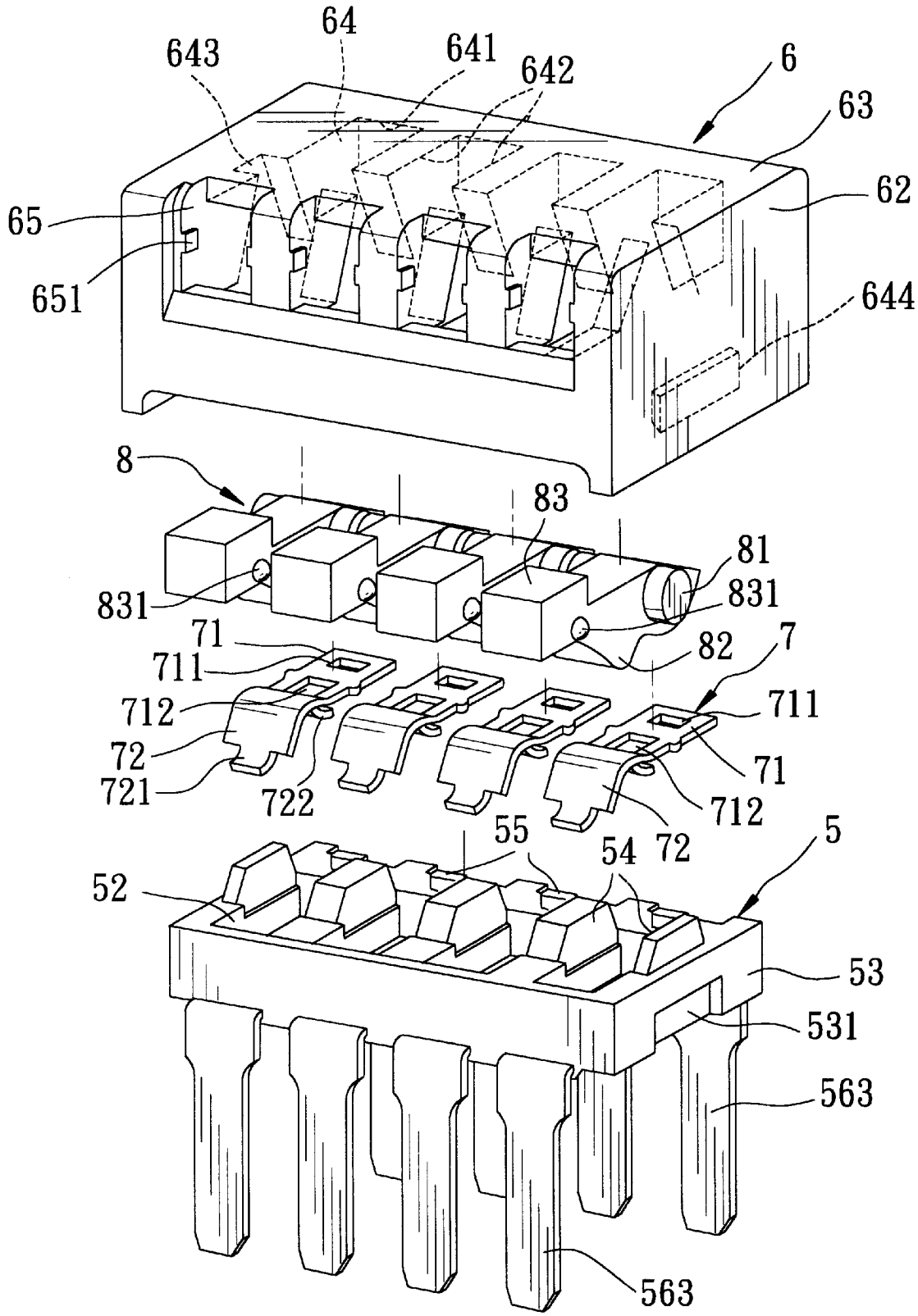
FIG. 5 is an exploded perspective view showing the preferred embodiment of a state-setting switch according to the present invention.
Figure 6:
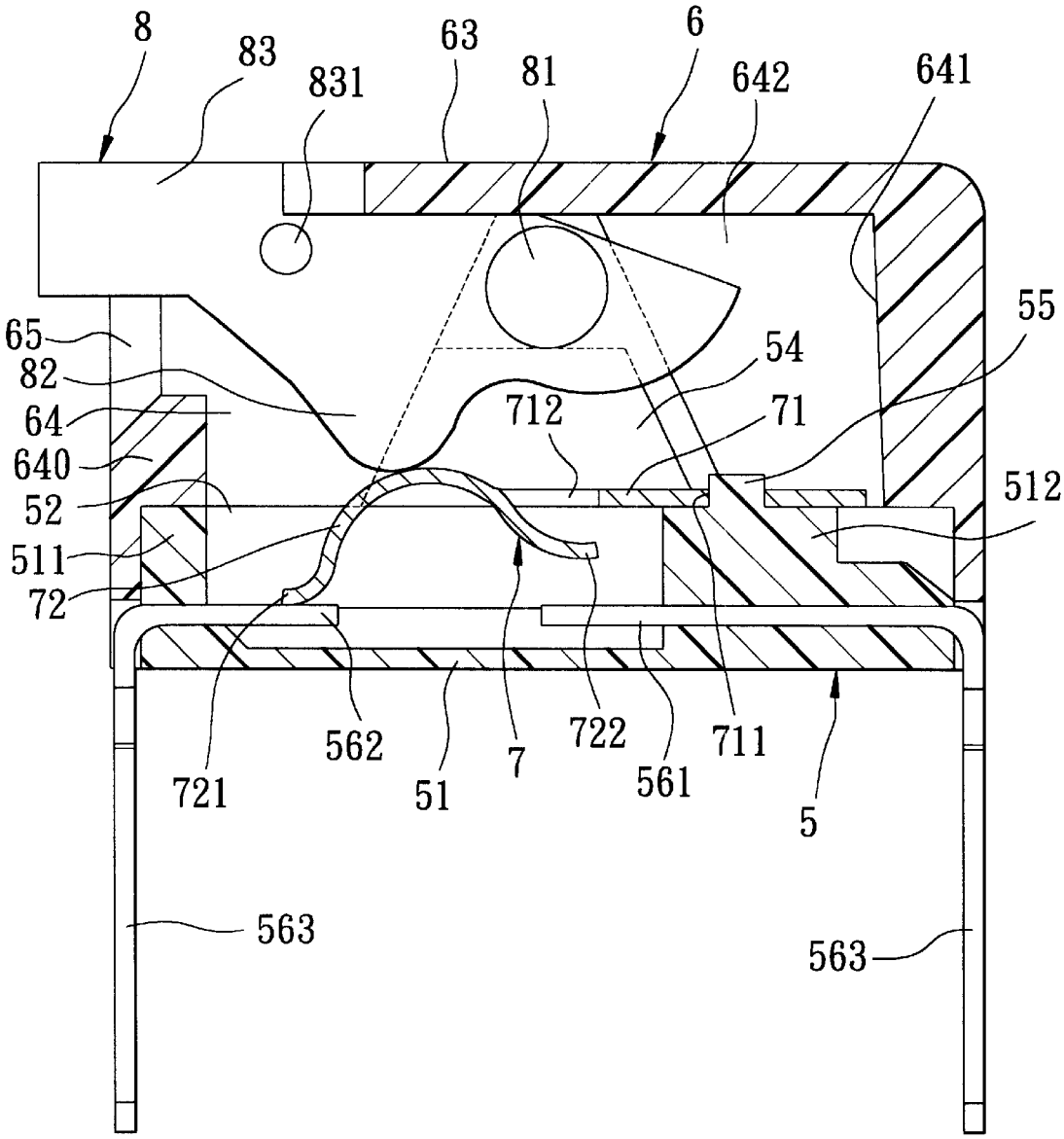
FIG. 6 is an assembled partly sectional view of the preferred embodiment of the present invention in a switch-off state.

Referring to FIGS. 5 and 6, the preferred embodiment of a state-setting switch according to the present invention is shown to include a lower insulator body 5, an upper insulator body 6 mounted on the lower insulator body 5, and a plurality of identical sets (four sets in this embodiment) of a resilient conductive contact member 7 disposed on the lower insulator body 5, a pivotable actuator 8 mounted pivotably on the upper insulator body 6, and a front terminal 562 and a rear terminal 561.

The lower insulator body 5 is made of an insulator material, such as rubber or plastic, and includes a bottom wall 51 with front and rear portions spaced apart in a longitudinal direction and left and right portions spaced apart in a transverse direction transverse to the longitudinal direction, front and rear lower walls 511, 512 respectively extending upward from the front and rear portions of the bottom wall 51, and left and right lateral walls 53 respectively extending upward from the left and right portions of the bottom wall 51. The lower insulator body 5 is defined with a plurality of upwardly opening terminal bridging cavities 52 (four cavities in this embodiment).

The front terminal 562 and the rear terminal 561 are spaced apart from each other in the longitudinal direction. Each of the front and rear terminals 562, 561 has a middle portion embedded in a junction between the bottom wall 51 and a respective one of the front and rear lower walls 511, 512, a contact end portion extending from the middle portion into the terminal bridging cavity 52, and a connecting end portion 563 extending from the middle portion and outwardly of the terminal bridging cavity 52. Preferably, the connecting end portion 563 extends downwardly relative to the bottom wall 51.

The conductive contact member 7, which is made of an alloy of titanium and copper in this embodiment, includes an anchoring segment 71 mounted on the rear lower wall 512 of the lower insulator body 5, and a bridging segment 72 extending from the anchoring segment 71 in the longitudinal direction and disposed above the contact end portions of the front and rear terminals 562, 561 in the terminal bridging cavity 52. The bridging segment 72 of the contact member 7 includes a first curved section 721 for contacting the contact end portion of the front terminal 562, and a second curved section 722 for contacting the contact end portion of the rear terminal 561. The anchoring segment 71 of the contact member 7 is planar and is formed with a positioning hole 711 therethrough. The rear lower wall 512 of the lower insulator body 5 has a top side formed with a positioning block 55 for engaging the positioning hole 711. The lower insulator body 5 further includes left and right lower walls 54 extending upwardly from bottom wall 51 and disposed at opposite sides of the contact member 7, thus positioning the contact member 7 securely in the terminal bridging cavity 52.

The upper insulator body 6 includes a top wall 63 with front and rear ends spaced apart in the longitudinal direction, and front and rear upper walls 640, 641 respectively extending downward from the front and rear ends of the top wall 63. The upper insulator body 6 is defined with a plurality of downwardly opening actuator mounting cavities 64. The front and rear upper walls 640, 641 respectively engage the front and rear lower walls 511, 512. The upper insulator body 6 has a plurality of actuator slots 65 formed through the front upper wall 640 and the front end of the top wall 63. Each of the actuator slots 65 is communicated with a corresponding actuator mounting cavity 64.

Preferably, a tongue-and-groove unit is provided on the lower insulator body 5 and the upper insulator body 6 for interlocking the same. In this embodiment, the tongue-and-groove unit includes projections 644 on left and right side walls 62 of the upper insulator body 6, and grooves 531 in the lateral walls 53 of the lower insulator body 5. The upper insulator body 6 further includes left and right upper walls 642 extending downwardly from the top wall 64 and formed with a notch 643 to receive a respective one of the left and right lower walls 54 of the lower insulator body 5 therein.

Each pivotable actuator 8 includes a mounting portion 81 disposed pivotally in the respective actuator mounting cavity 64 and pivotable about a pivot axis that extends in the transverse direction, an operating portion 83 extending from the mounting portion 81 outwardly of the actuator mounting cavity 64 via the corresponding actuator slot 65, and a pressing projection 82 projecting downwardly from the mounting portion 81 toward the bridging segment 72 of the.contact member 7.

The mounting portion 81 of the pivotable actuator 8 is formed with left and right axles, each of which extends into the notch 643 in a respective one of the left and right upper walls 642 and is supported by a respective one of the left and right lower walls 54 of the lower insulator body 5.

During assembly, the contact members 7 are first positioned on the lower insulator body 5. The left and right lower walls 54 of the lower insulator body 5 serve as barriers to facilitate proper positioning of the contact members 7. As shown in FIG. 6, the first curved sections 721 of the bridging segments 72 are in contact with the contact end portions of the front terminals 562, and the second curved sections 722 of the bridging segments 72 are spaced apart from the contact end portions of the rear terminals 561. Then, the pivotable actuators 8 engage the notches 643 in the left and right upper walls 642, and the upper insulator body 6 is disposed on top of the lower insulator body 5 such that the pressing projections 82 of the pivotable actuators 8 abut against the bridging segments 72 of the contact members 7. After the upper insulator body 6 is locked to the lower insulator body 5, resin is applied to seal the gaps between the upper insulator body 6 and the lower insulator body 5 to complete the assembly process.

Figure 7:
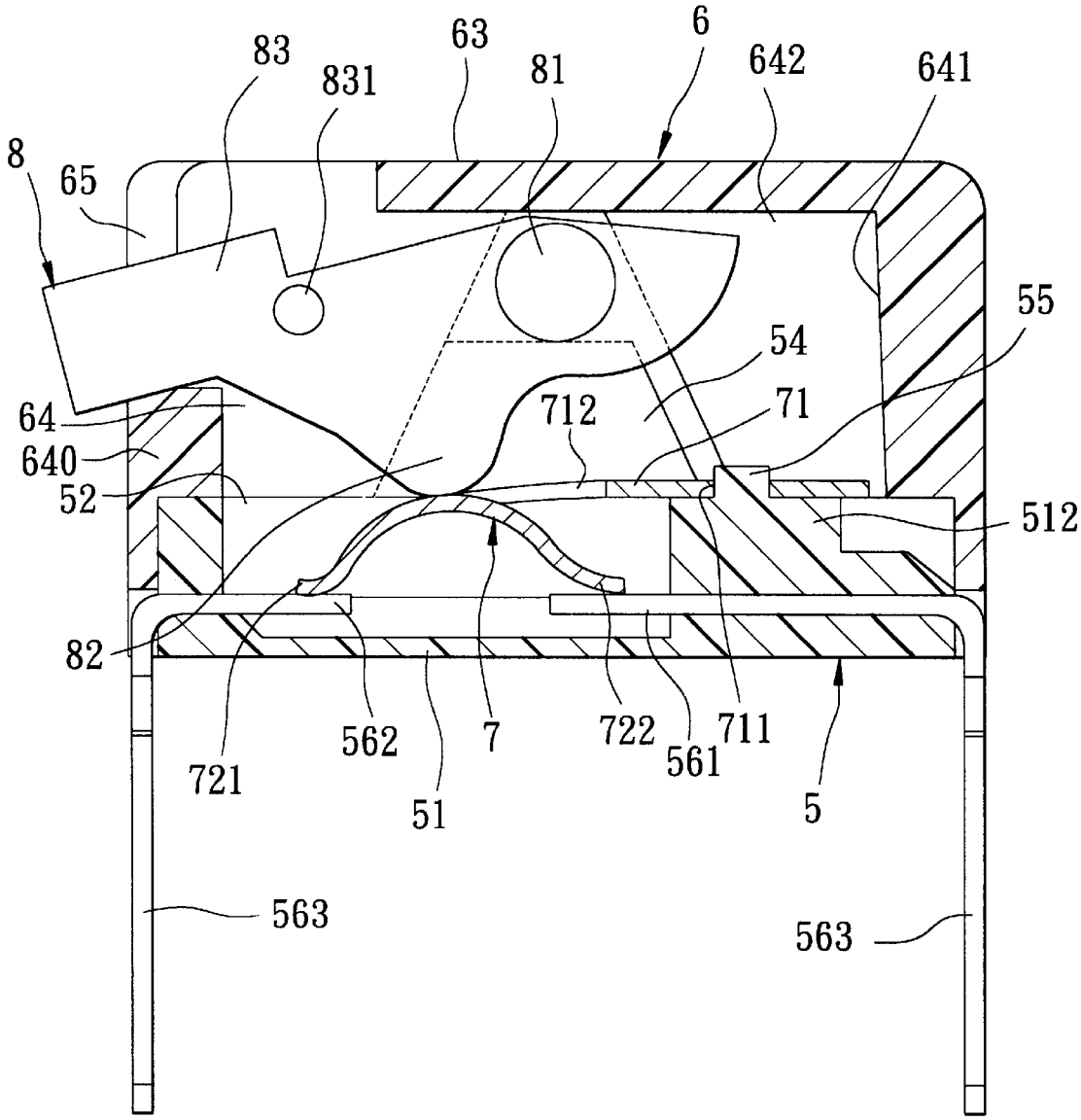
FIG. 7 is an assembled partly sectional view of the preferred embodiment of the present invention in a switch-on state.

As shown in FIG. 6, when the pivotable actuator 8 is at a switch-off state, the first curved section 721 is in contact with the contact end portion of the front terminal 562, and the second curved section 722 is spaced apart from the contact end portion of the rear terminal 561, thereby breaking electrical connection between the front and rear terminals 562, 561. As shown in FIG. 7, to operate the pivotable actuator 8 from the switch-off state to the switch-on state, a pressing force is applied on the operating portion 83 to cause the actuator 8 to pivot in the actuator mounting cavity 64 and to enable the pressing projection 82 to press the bridging segment 72 downward so that the first curved section 721 is in contact with the contact end portion of the front terminal 562, and the second curved section 722 is in contact with the contact end portion of the rear terminal 561, thereby making electrical connection between the front and rear terminals 562, 561.

In practice, a retaining unit is provided on the pivotable actuator 8 and the upper insulator body 5 for releasably retaining the pivotable actuator 8 at the switch-on state. In this embodiment, the retaining includes a stop flange 651 on the upper insulator body 6 and a stop flange 831 on the pivotable actuator 8, as shown in FIG. 5.

The following are some of the advantages of the switch of this invention:

1. Since the contact member 7 is made of an alloy of copper and titanium, it possesses much better resilience as compared to terminals made of copper and has greater resistance to spring fatigue.

2. The bridging design for connection between the terminal 562, 561 avoids the problems of friction and impact of springing action of terminals that occur in the conventional switch, and thus prolong the service life of the switch.

3. The existence of the positioning hole 711 and another hole 722 proximate thereto in the contact member 7 can facilitate automated assembly of the contact members 7 during mass production, thereby reducing the assembly time and cost.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A switch comprising:

a lower insulator body including a bottom wall with front and rear portions spaced apart in a longitudinal direction, and front and rear lower walls respectively extending upward from said front and rear portions of said bottom wall so as to define an upwardly opening terminal bridging cavity;

front and rear terminals spaced apart from each other in the longitudinal direction, each of said front and rear terminals having a middle portion embedded in a junction between said bottom wall and a respective one of said front and rear lower walls, a contact end portion extending from said middle portion into said terminal bridging cavity, and a connecting end portion extending from said middle portion and outwardly of said terminal bridging cavity;

a resilient conductive contact member having an anchoring segment mounted on said rear lower wall, and a bridging segment extending from said anchoring segment in the longitudinal direction and disposed above said contact end portions of said front and rear terminals in said terminal bridging cavity;

an upper insulator body including a top wall with front and rear ends spaced apart in the longitudinal direction, and front and rear upper walls respectively extending downward from said front and rear ends of said top wall so as to define a downwardly opening actuator mounting cavity, said front and rear upper walls respectively engaging said front and rear lower walls, said upper insulator body having an actuator slot formed through said front upper wall and communicated with said actuator mounting cavity; and a pivotable actuator having a mounting portion disposed pivotally in said actuator mounting cavity and pivotable about a pivot axis that extends in a transverse direction transverse to the longitudinal direction, an operating portion extending from said mounting portion outwardly of said actuator mounting cavity via said actuator slot, and a pressing projection projecting downwardly from said mounting portion toward said bridging segment of said contact member;

wherein application of a pressing force on said operating portion of said actuator causes said actuator to pivot in said actuator mounting cavity to a switch-on state and enables said pressing projection to press said bridging segment of said contact member downward so that said bridging segment bridges together said contact end portions of said front and rear terminals to make electrical connection between said front and rear terminals and;

wherein said lower insulator body further includes left and right lower walls extending upwardly from said bottom wall and disposed at opposite lateral sides of said contact member.

2. The switch as claimed in claim 1, wherein said upper insulator body further includes left and right upper walls extending downwardly from said top wall and formed with a notch to receive a respective one of said left and right lower walls therein.

3. The switch as claimed in claim 2, wherein said mounting portion of said pivotable actuator is formed with left and right axles, each of said left and right axles extending into said notch in a respective one of said left and right upper walls and being supported by a respective one of said left and right lower walls.

4. A switch comprising:

a lower insulator body including a bottom wall with front and rear portions spaced apart in a longitudinal direction, and front and rear lower walls respectively extending upward from said front and rear portions of said bottom wall so as to define an upwardly opening terminal bridging cavity;

front and rear terminals spaced apart from each other in the longitudinal direction, each of said front and rear terminals having a middle portion embedded in a junction between said bottom wall and a respective one of said front and rear lower walls, a contact end portion extending from said middle portion into said terminal bridging cavity, and a connecting end portion extending from said middle portion and outwardly of said terminal bridging cavity;

a resilient conductive contact member having an anchoring segment mounted on said rear lower wall, and a bridging segment extending from said anchoring segment in the longitudinal direction and disposed above said contact end portions of said front and rear terminals in said terminal bridging cavity;

an upper insulator body including a top wall with front and rear ends spaced apart in the longitudinal direction, and front and rear upper walls respectively extending downward from said front and rear ends of said top wall so as to define a downwardly opening actuator mounting cavity, said front and rear upper walls respectively engaging said front and rear lower walls, said upper insulator body having an actuator slot formed through said front upper wall and communicated with said actuator mounting cavity; and a pivotable actuator having a mounting portion disposed pivotally in said actuator mounting cavity and pivotable about a pivot axis that extends in a transverse direction transverse to the longitudinal direction, an operating portion extending from said mounting portion outwardly of said actuator mounting cavity via said actuator slot, and a pressing projection projecting downwardly from said mounting portion toward said bridging segment of said contact member;

wherein application of a pressing force on said operating portion of said actuator causes said actuator to pivot in said actuator mounting cavity to a switch-on state and enables said pressing projection to press said bridging segment of said contact member downward so that said bridging segment bridges together said contact end portions of said front and rear terminals to make electrical connection between said front and rear terminals and;

wherein said anchoring segment of said contact member is planar and is formed with a positioning hole therethrough, said rear lower wall of said lower insulator body having a top side formed with a positioning block for engaging said positioning hole.

* * * * *